US007000255B1

(12) United States Patent
Baacke

(10) Patent No.: US 7,000,255 B1
(45) Date of Patent: Feb. 21, 2006

(54) GARMENT WITH ADJUSTABLE WEIGHT SUPPORT MECHANISM

(75) Inventor: Dennis R. Baacke, Irma, WI (US)

(73) Assignee: JMI (USA) Ltd., Merrill, WI (US)

( * ) Notice: Subject to any disclaimer, the term of this patent is extended or adjusted under 35 U.S.C. 154(b) by 300 days.

(21) Appl. No.: 10/200,668

(22) Filed: Jul. 22, 2002

Related U.S. Application Data

(60) Provisional application No. 60/342,136, filed on Dec. 18, 2001.

(51) Int. Cl.
*A41D 3/02* (2006.01)

(52) U.S. Cl. ..... 2/94

(58) Field of Classification Search ..... 2/94, 2/69, 69.5, 79, 102, 44–45, 81, 327, 93, 456, 2/461, 462, 247–253
See application file for complete search history.

(56) References Cited

U.S. PATENT DOCUMENTS

| | | | | |
|---|---|---|---|---|
| 939,871 | A | 11/1909 | Sherman | |
| 1,845,089 | A | 2/1932 | Popelakova et al. | |
| 2,248,455 | A | 7/1941 | Freund | |
| 2,620,479 | A | 12/1952 | Buck | |
| 3,105,241 | A | 10/1963 | Allen | |
| 3,424,134 | A | 1/1969 | Rosenblum | |
| 3,529,307 | A | 9/1970 | Belson et al. | |
| 3,701,395 | A | 10/1972 | Theobald | |
| 4,106,121 | A | 8/1978 | Belson | |
| 4,177,877 | A | 12/1979 | Gallinati | |
| 4,273,216 | A | 6/1981 | Weissmann | |
| 4,512,437 | A | 4/1985 | Savage | |
| 4,637,075 | A | 1/1987 | Ingrisano et al. | |
| 4,669,127 | A | 6/1987 | Swanson | |
| 4,700,409 | A | 10/1987 | De Lott | |
| 4,723,695 | A | 2/1988 | Farber | |
| 4,731,882 | A | 3/1988 | Ekman | |
| 4,949,401 | A | 8/1990 | Kimsey, Jr. | |
| 5,014,359 | A | 5/1991 | Hanson | |
| 5,220,976 | A | 6/1993 | Gunter | |
| 5,247,707 | A | 9/1993 | Parker et al. | |
| 5,323,942 | A * | 6/1994 | Dahan | 224/639 |

(Continued)

FOREIGN PATENT DOCUMENTS

| | | |
|---|---|---|
| DE | 77 05 371 | 6/1977 |

(Continued)

*Primary Examiner*—Tejash Patel
(74) *Attorney, Agent, or Firm*—Boyle Fredrickson Newholm Stein & Gratz S.C.

(57) ABSTRACT

A garment including an adjustable weight support mechanism used to shift the weight and position of objects contained within pockets disposed on the garment is provided. The garment has a number of pockets including a storage pouch releasably attached to the rear of the garment. The support mechanism is attached to the garment and includes a pair of strap assemblies which extend from the shoulders of the garment downwardly towards the bottom of front and rear panels forming the garment. The first strap of each assembly is connected between the shoulder of the garment and the front panel. The second strap assembly is connected between the rear panel and the first strap, and is adjustable in length. When the second strap is pulled to shorten the length of the second strap, the second strap pulls the first strap downwardly and forwardly to pull the shoulders and rear panel of the garment upwardly and move the weight contained in the storage pouch upwardly onto the shoulders of the wearer of the garment, and off of the lower back.

33 Claims, 8 Drawing Sheets

U.S. PATENT DOCUMENTS

| | | | | |
|---|---|---|---|---|
| 5,450,627 | A | | 9/1995 | Grilliot et al. |
| 5,544,363 | A | | 8/1996 | McCue et al. |
| 5,738,046 | A | | 4/1998 | Williams et al. |
| 5,860,164 | A | | 1/1999 | Johnson |
| 5,864,880 | A | | 2/1999 | Adam |
| 5,893,370 | A | | 4/1999 | Perez et al. |
| 5,909,802 | A | | 6/1999 | Puco et al. |
| 5,960,480 | A | | 10/1999 | Neustater et al. |
| 5,970,517 | A | | 10/1999 | Jordan |
| 6,035,440 | A | | 3/2000 | Woodyard |
| 6,101,631 | A | | 8/2000 | Ferguson, Jr. |
| 6,120,213 | A | * | 9/2000 | Stinton ..... 405/186 |
| 6,131,199 | A | | 10/2000 | Bugel et al. |
| 6,233,740 | B1 | | 5/2001 | Meyers et al. |
| RE37,394 | E | * | 10/2001 | Woodyard ..... 2/102 |
| 6,295,650 | B1 | * | 10/2001 | Baacke ..... 2/94 |
| 6,305,024 | B1 | | 10/2001 | Schweer |
| D453,398 | S | | 2/2002 | Masuda |
| 6,378,465 | B1 | | 4/2002 | Austin |

FOREIGN PATENT DOCUMENTS

| | | |
|---|---|---|
| WO | WO 01/12267 A1 | 2/2001 |

* cited by examiner

GARMENT WITH ADJUSTABLE WEIGHT SUPPORT MECHANISM

CROSS-REFERENCE TO RELATED APPLICATIONS

This application claims priority under 35 U.S.C. § 119(e) to U.S. Provisional Patent Application No. 60/342,136, filed Dec. 18, 2001, which is incorporated herein in its entirety.

FIELD OF THE INVENTION

The present invention relates generally to garments or articles of clothing including pockets in which a number of objects can be placed, and more specifically to clothing having a weight adjustment mechanism connected thereto in order to shift or reposition the weight of the objects in the pockets of the garment as it rests on the person wearing the garment.

BACKGROUND OF THE INVENTION

People often wear various types of garments or articles of clothing outdoors, such as vests, overalls, coveralls and jackets in order to insulate them from the effects of the elements. These articles of clothing normally include a number of pockets of various shapes and sizes which can accommodate a number of different items to be carried by the individual. The pockets can be located on both the exterior and interior of the clothing such that a greater number of items can be carried within the clothing. Many types of garments also include various specialized pockets designed to accommodate certain specific items having well defined and unique configurations. An example of such a pocket is a water bottle pocket in which a cylindrical water bottle can be releasably held.

Furthermore, certain types of garments have been developed in which an article holding device, such as an enlarged pocket or pouch, can be releasably attached to the garment, to greatly increase the storage capacity of and types of items that can be held or carried by the garment. However, in garments having this type of pouch, the storage pouch is normally attached to the rear panel of the garment and the weight of any objects positioned within the pouch pulls downwardly on the rear panel of the garment. This consequently pulls the shoulders of the garment rearwardly, and the front panel of the garment upwardly, such that the garment and the weight of the objects in the pouch is uncomfortably positioned on the person. More specifically, in this position the objects in the pouch are disposed against the lower back of the person or below, while the collar or neck of the garment is pressed upwardly against the underside of the neck or chin of the person.

In response to this problem, some garments have been developed that allow for the repositioning of the pouch and the weight in the pouch to attempt to avoid the discomfort provided by previous garment designs. For example, Puco et al. U.S. Pat. No. 5,909,082 discloses a vest backpack in which a backpack is releasably secured to the vest by a number of zippers and by a load adjustment member that is movably secured to the vest. The load adjustment member is secured to the vest by a pair of rear straps extending from the load adjustment member and fixedly secured to the rear panel, and a pair of front straps fixedly secured to the load adjustment member opposite the rear straps and fixedly secured to the front panel. The adjustment member is moved by adjusting the length of the front straps to raise or lower the load adjustment member on the rear panel. By raising or lowering the adjustment member, the backpack can be positioned at different levels on the rear panel on the vest.

However, in this particular vest construction, each of the front and rear straps is fixedly secured to the front and rear panels, respectively, of the vest, which function as the anchoring points for the adjustment member. Thus, in order to prevent the adjustment member and straps from simply pulling upwardly on the front and rear panels of the vest, thereby bunching the panels of the vest and leaving the adjustment member in a stationary position, this vest construction requires a waist belt to be attached to the vest at the point of connection of the front and rear straps to the front and rear panels of the vest. The function of the waist belt is to maintain the position of the vest on the wearer such that the adjustment of the front straps will function to raise the adjustment member on the rear panel. However, on many occasions where the belt is not used or is improperly secured, when the front straps are adjusted in length to raise the adjustment member, the adjustment of the front straps simply pulls upwardly on the waist belt and front panel, thus bunching the front panel of the vest upwardly instead of moving the adjustment member as intended.

Therefore, it is desirable to develop a garment or article of clothing having a number of pockets for holding items and an adjustable weight support mechanism which can be used to shift the weight of the items in the pockets into a comfortable position for the wearer without the need for a separate waist belt.

SUMMARY OF THE INVENTION

It is an object of the present invention to provide a garment or article of clothing, including an adjustable weight support mechanism capable of adjusting the position of the garment on the wearer when objects are carried within pockets or other article holders disposed on the garment.

It is another object of the invention to provide a garment including an adjustable weight support mechanism which is attached to the garment and does not require a waist belt or similar anchor point to prevent the garment from bunching up when the mechanism is used.

It is still another object of the invention to provide a garment including an adjustable weight support mechanism that can be positioned on either the exterior of the clothing or on the interior of the clothing and accessed through openings in the exterior of the garment.

It is still a further object of the invention to provide a garment including an adjustable weight support mechanism and a storage pouch that is attached to a rear panel of the clothing.

It is still another object of the invention to provide a garment including an adjustable weight support mechanism that has a simple construction and is easy to use.

The present invention is a garment or article of clothing such as a vest, overalls, coveralls, or a jacket, among others, including an adjustable weight support mechanism disposed on either the exterior or the interior of the garment. The support mechanism is capable of adjusting the position of the garment with respect to the wearer when objects are placed in one or more pockets or pouches or other article holders on the garment, including a pouch that can be fixedly or releasably attached to the rear of the garment. The weight support mechanism includes a first pair of straps that are adjustable in length and are attached at one end to the rear panel of the garment and at the opposite end to one of a pair of second straps. Each of the pairs of second straps is interconnected between one of the front panels of the jacket and the midpoint of each shoulder portion of the garment. Each front panel of the garment also includes an opening which allows an individual to reach through the opening to grasp one of the first straps and adjust its length.

To adjust the position of the garment on the wearer, when these first straps are grasped and pulled to adjust the length of the straps, the first straps shorten in length and consequently draw or pull the second straps downwardly towards the waist of the wearer. As the second straps are pulled downwardly, each second strap draws the shoulders of the garment forwardly to adjust the position of the garment, the rear pouch, and the weight of the objects in the pouch by rotating the garment around the shoulders of the wearer.

Various other features, objects and advantages of the invention will be made apparent from the following detailed description taken together with the drawings.

BRIEF DESCRIPTION OF THE DRAWINGS

The drawings illustrate the best mode currently contemplated of practicing the invention.

In the drawings.

DETAILED DESCRIPTION OF THE INVENTION

Figure 1:
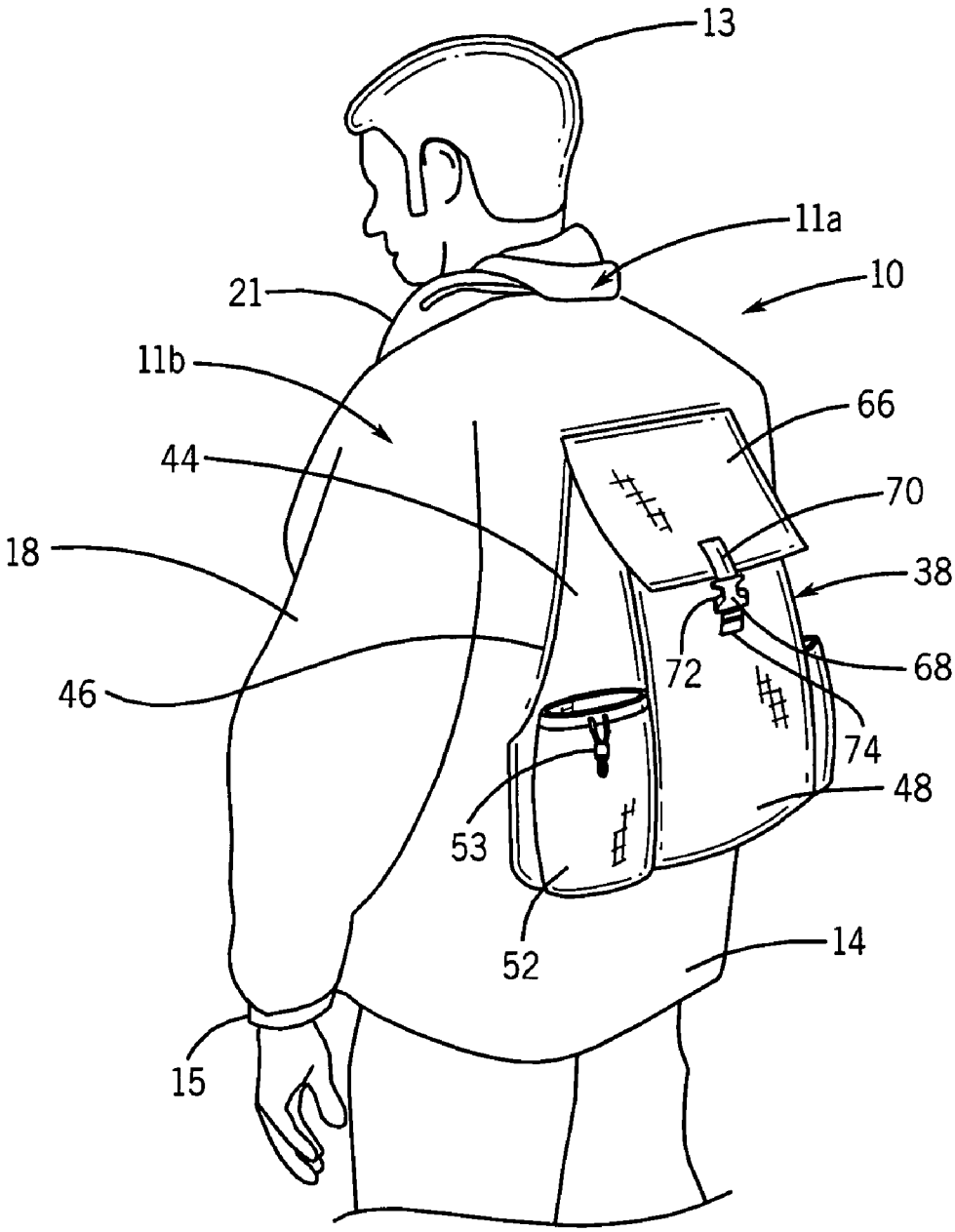
FIG. 1 is an isometric view of a garment incorporating an adjustable eight support mechanism constructed according to the present invention worn by a person.
Figure 2:
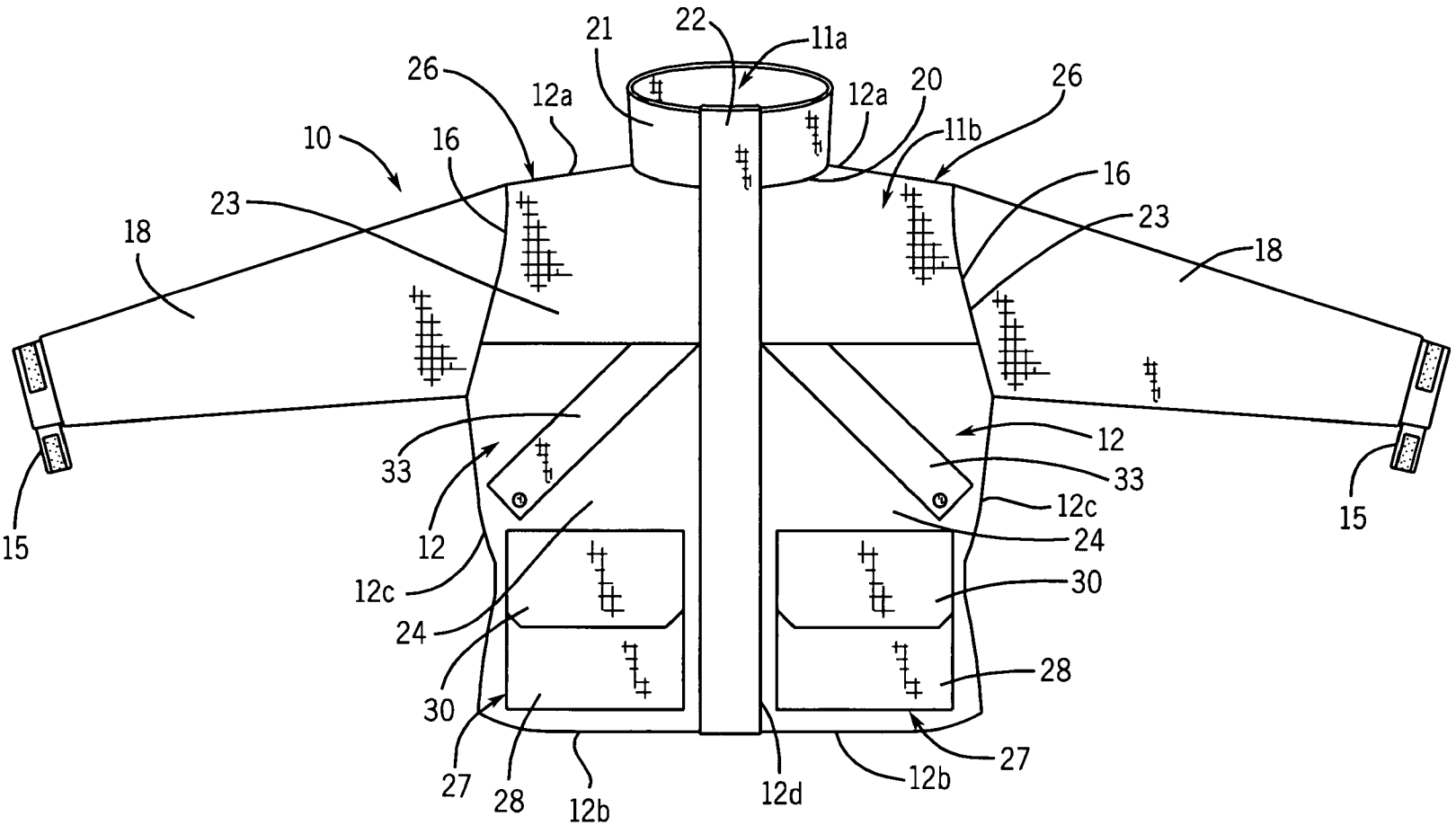
FIG. 2 is a front plan view of the garment of FIG. 1.
Figure 3:
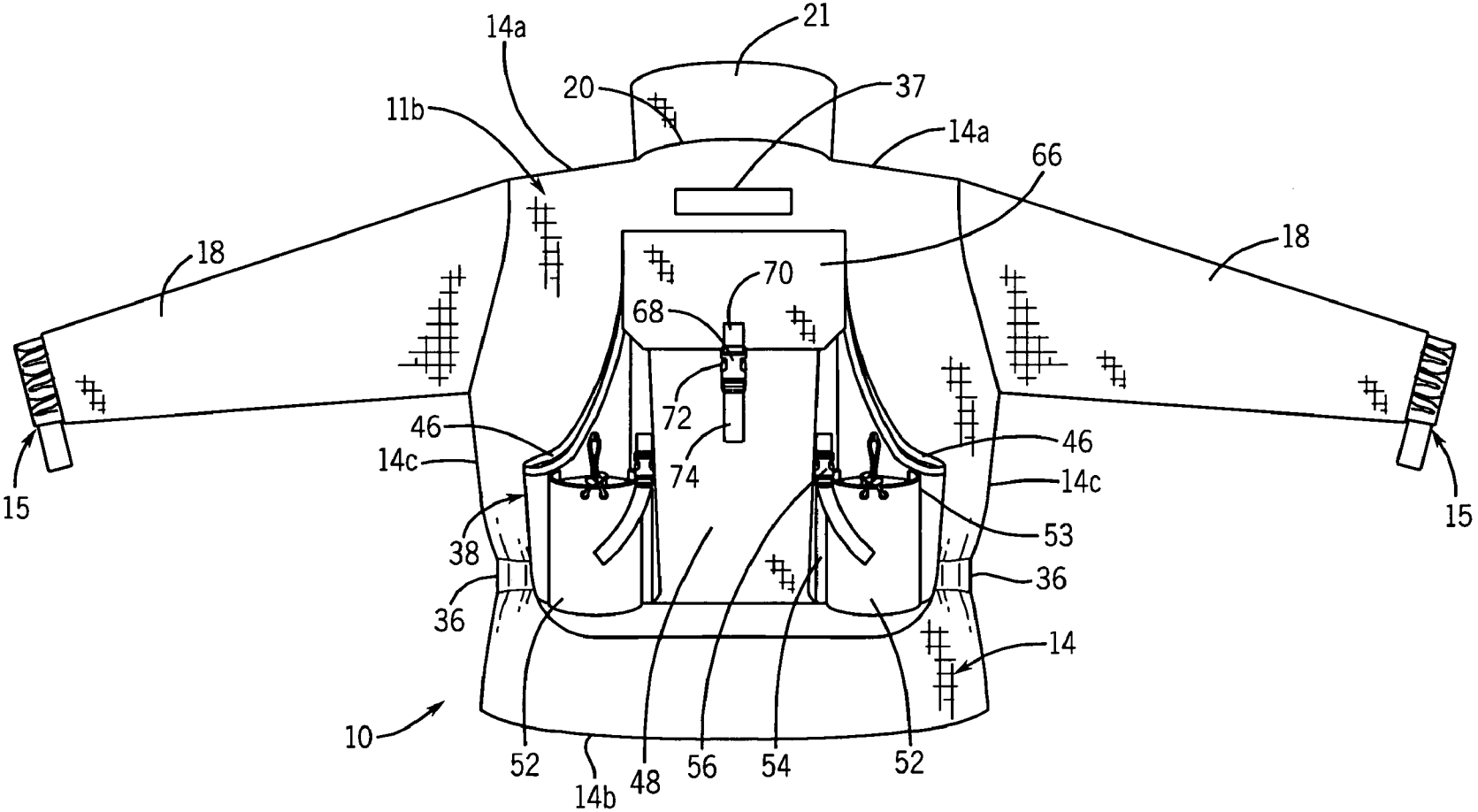
FIG. 3 is a rear plan view of the garment of FIG. 1.

With regard now to the following detailed description in which like reference numerals designate like parts throughout the disclosure, a garment or article of clothing constructed according to the present invention is indicated generally at 10 in FIG. 1. As best shown in FIGS. 1–3, the garment 10 worn by a wearer 13 defines an interior surface 11*a* and an exterior surface 11*b* and includes a pair of front panels 12 each having a top end 12*a*, a bottom end 12*b* and a pair of opposed sides 12*c* and 12*d*. The garment 10 also includes a rear panel 14 that has an upper end 14*a*, a lower end 14*b* and a pair of opposed edges 14*c*. The top end 12*a* and side 12*c* of each of the front panels 12 are secured to the upper end 14*a* and the edges 14*c* of the rear panel 14, respectively, by any suitable means such as stitching (not shown). The opposed edges 14*c* of the rear panel 14 and the adjacent sides 12*c* of each front panel 12 cooperate to define a pair of circular arm or sleeve openings 16 therebetween. The openings 16 are encircled by a pair of generally cylindrical, elongate arms or sleeves 18 extending outwardly from opposite sides of the garment 10 and terminating in wrist closures 15.

Each front panel 12 further includes one half of a suitable releasable closure mechanism 19, such as a hook and loop closure, a snap closure, or a zipper closure, that is disposed on the side 12*d* of each front panel 12 and is used to secure the front panels 12 to one another into a unitary front panel. The closure 19 may also be omitted in a separate embodiment where the garment 10 includes only a single front panel 12 secured to the rear panel 14 at opposite ends.

When the closure 19 is engaged, the top ends 12*a* of the front panels 12 and the upper end 14*a* of the rear panel 14 further define a neck opening 20 above and between the arms 18. The neck opening 20 is preferably encircled by a collar 21 extending upwardly from and secured to each of the top ends 12*a* of the front panels 12 and the upper end 14*a* of the rear panel 14. The closure 19 can further extend upwardly from the front panels 12 through the collar 21 in order to enable the front panels 12 and collar 21 to be completely joined and separated along their entire length, allowing the wearer to easily put on and secure, or take off the garment 10.

The closure 19 can also be selectively covered by a wind flap 22 attached to one of the front panels 12 and one end of the collar 21. The wind flap 22 can be selectively engaged with a number of closures (not shown) disposed on the opposite front panel 12 and the other end of the collar 21 to allow the wind flap 22 to be held over the closure 19 along its entire length. In other embodiments, the flap 22 can include a neck/chin flap (not shown) attached to the interior 11*a* of the garment 10, the flap 22 can be disposed on the interior 11*a* of the garment 10, or the flap 22 can be omitted altogether from the garment 10. The front panels 12, rear panel 14, arms 18, collar 21 and flap 22 of the garment 10 can be formed from any suitable garment material, such as nylon or canvas, or any fabric formed of natural or synthetic fibers, among others.

Figure 6:
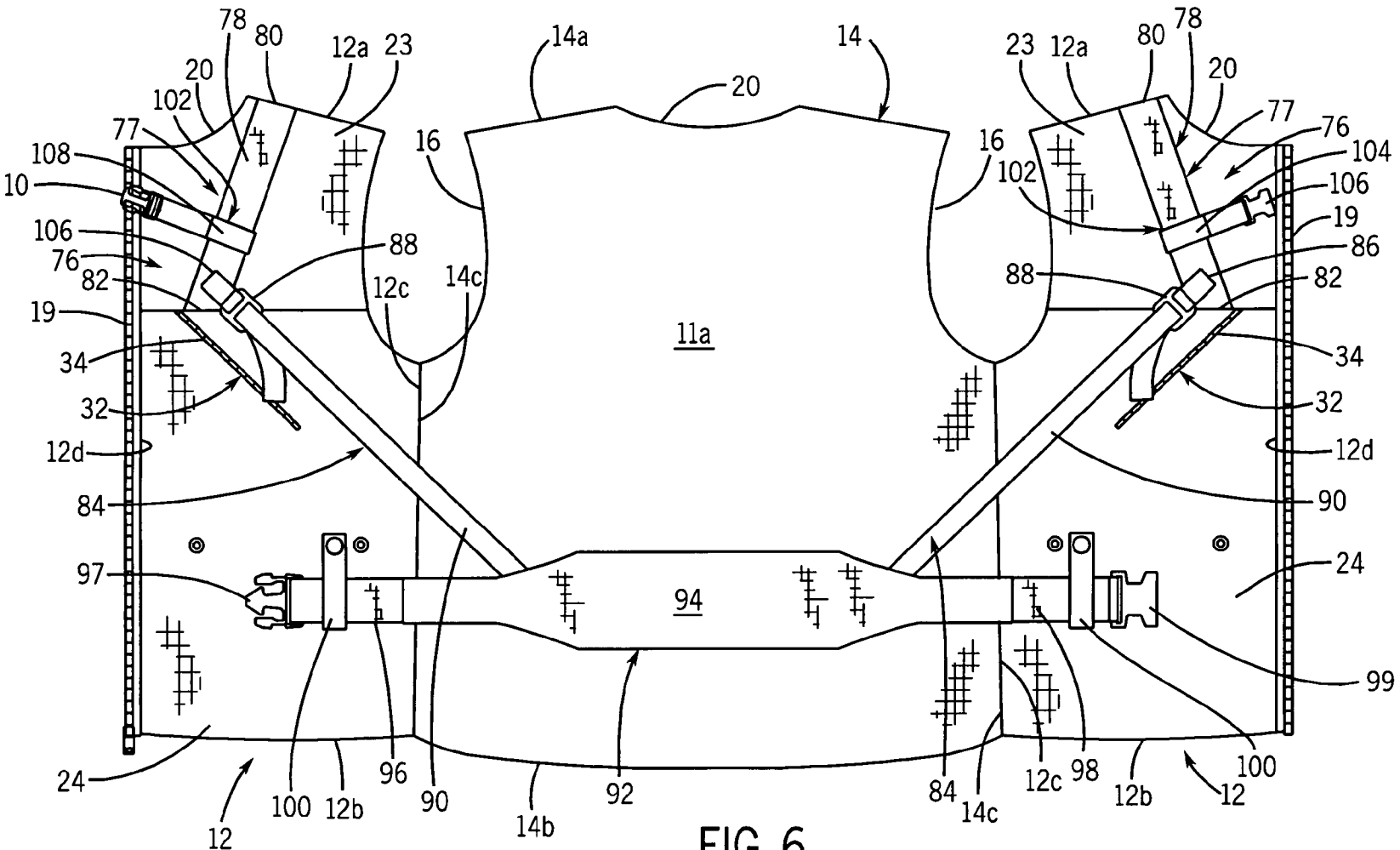
FIG. 6 is a front plan view of the interior of the garment of FIG. 1 illustrating the adjustable weight support mechanism.

Referring now to FIGS. 2 and 6, the front panels 12 are each formed of an upper portion 23 adjacent the top end 12*a*, and a lower portion 24 adjacent the bottom end 12*b*. The upper portions 23 of each front panel 12 and the upper part of the rear panel 14 form a pair of opposed shoulder portions 26 between the neck opening 20 and each of the sleeve openings 16. The lower portions 24 each include a cargo pocket 27 disposed on the exterior surface 11*b* of the garment 10 and opposite the upper portion 23. Preferably, the pockets 27 are formed of a lower pouch 28 and an adjacent upper flap 30. The flap 30 on each pocket 27 can be releasably secured and moved with respect to the pouch 28 to allow objects to be placed and removed from within each pocket 27 while the jacket 10 is being worn.

Each lower portion 24 also includes a pair of angled access openings 32 that extend through the garment 10 from the exterior surface 11*b* to the interior surface 11*a* and are disposed above each pocket 27. Each opening 32 includes a flap 33 covering a selectively openable closure 34 (such as a hook and loop closure, a snap closure, or a zipper closure) that serves to maintain the openings 32 in a closed configuration until the wearer 13 wants access to the interior surface 11*a* of the garment 10 through the openings 32. Alternatively, the openings 32 can simply be openings in the front panels 12 that are covered by the flap 33 without the closures 34.

Figure 4:
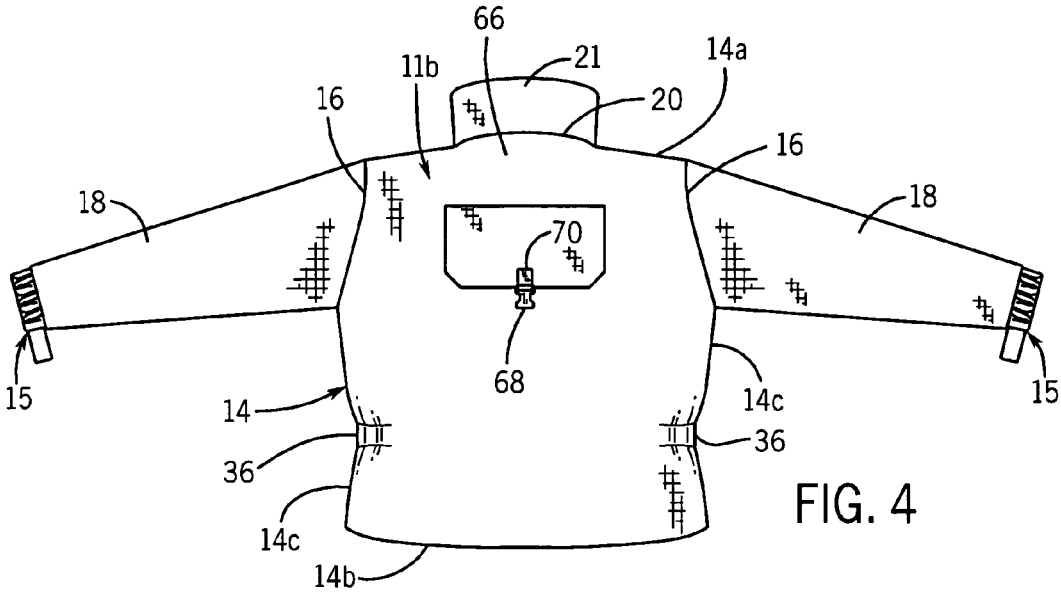
FIG. 4 is a rear plan view of the garment of FIG. 3 with the rear pouch removed.
Figure 5:
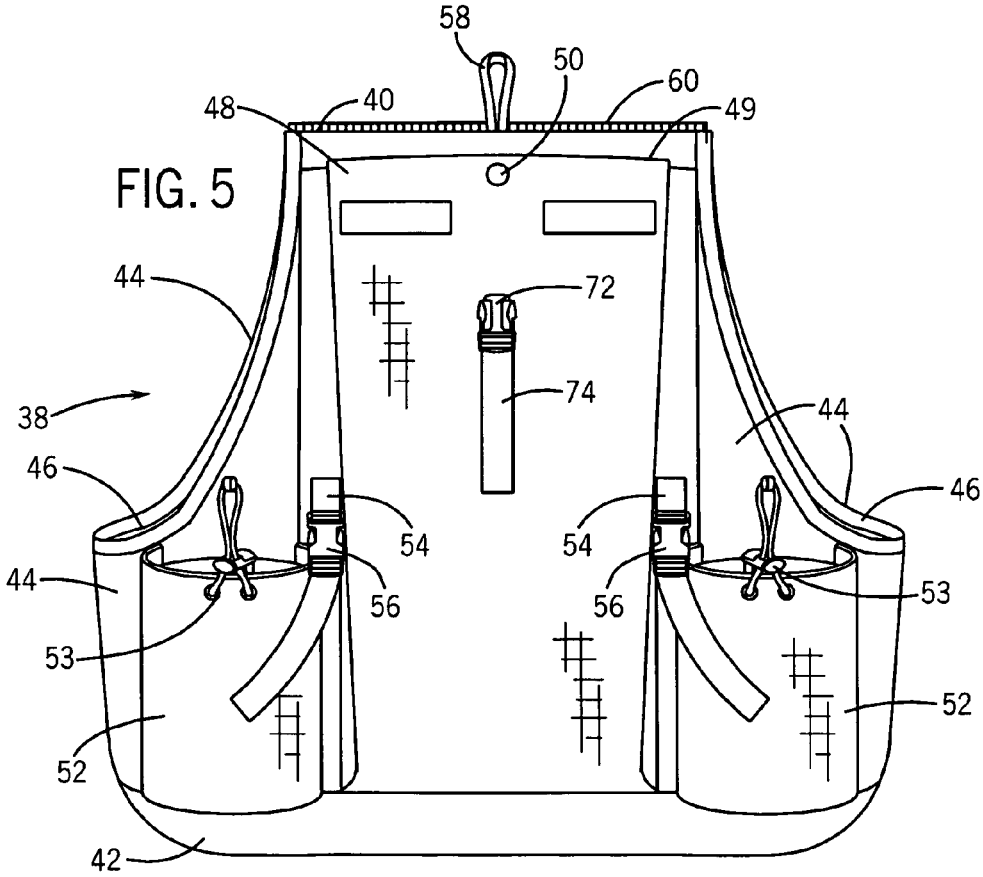
FIG. 5 is an isometric view of the rear pouch of the garment of FIG. 3.

Referring now to FIGS. 3–4, the rear panel 14 can optionally include a pair of elastic waist sections 36 disposed on opposite sides of the rear panel 14 near the lower end 14*b* that enable the rear panel 14 to closely conform to the shape and size of the waist of the wearer of the jacket 10.

Between and above the elastic members 36, the rear panel 14 also includes a hanging strap 37 for supporting the garment 10 on a hook (not shown).

Below the strap 37, the rear panel 14 also includes a removable storage pocket or pouch 38 which can be formed of the same material as the garment 10, or any other suitable material. The storage pouch 38 can have a variety of different configurations, but preferably includes a top end 40, a bottom panel 42, a pair of opposed side panels 44 joined to one another at the top end 40 and to opposite sides of the bottom panel 42, and a pair of openings 46 disposed between the side panels 44 and top end 40. The openings 46 allow access to the interior of the pouch 38 which extends completely between the side panels 44.

The pouch 38 may also include a secondary pocket 48 disposed on one panel 44 of the storage pocket 38 opposite the rear panel 14 that provides an additional storage location for objects on the storage pouch 38. The secondary pocket 48 has an open end 49 adjacent the top end 40 of the storage pouch 38 that includes a releasable closure 50, such as a hook and loop or snap closure, that allows objects to be removably held within the secondary pocket 48.

The storage pouch 38 may also include other features as well. For example, the pouch 38 can include a pair of water bottle pockets 52 disposed on opposite sides of the secondary pocket 48 and having elastic string closures 53. Furthermore in order to retain an object such as a bedroll on the exterior of the storage pouch 38, a pair of adjustable straps 54 is positioned on the pocket 48 opposite the pouch 38. The straps 54 include a buckle 56 that enables the straps 54 to be positioned around a rolled object such as a bedroll, and adjusted in length to secure the object to the storage pocket 38. The storage pouch 38 also includes a hanger loop 58 disposed on the top end 40 of the pouch 38 which enables the pouch 38 to be hung from a hook or other similar structure when removed from the garment 10. However, instead of a pouch 38 the garment 10 can also include other types of article holders such as straps, hooks, loops, or any other suitable holder.

In order to securely attach the storage pouch 38 to the garment 10, the top end 40 of the storage pouch 38 can include one half of a closure mechanism 60, such as a zipper, that extends across the top end 40. The opposite half of the closure mechanism (not shown) is attached to the center of the rear panel 14 approximately equidistant from the arms 18 and slightly below the strap 37. To secure the pouch 38 to the rear panel 14, both halves of the closure mechanism are positioned adjacent one another and engaged to releasably retain the pouch 38 on the garment 10.

To ensure that the closure mechanism 60 does not become snagged or disengaged such that the pouch 38 is inadvertently detached, and also to prevent water and unwanted objects from entering either the pouch 38 or pocket 48, the rear panel 14 includes a cover flap 66 fixedly attached to the rear panel 14 directly above the closure mechanism. The flap 66 can be formed of the same material as the garment 10 or any other suitable material and includes a securing member 68 attached to a strap 70 that extends downwardly from the cover flap 66. The securing member 68 can be releasably engaged with a complementary retaining member 72 located on a strap 74 attached to the storage pouch 38. When the securing member 68 is engaged with the retaining member 72, the cover flap 66 is maintained in a downwardly extending position to cover the closure mechanism and pouch 38. Alternatively, the pouch 38 can be fixedly secured to the jacket 10, such as by stitching (not shown).

To assist the closure mechanism in holding the pouch 38 on the rear panel 14, in another embodiment the rear panel 14 can also include one or more secondary securing mechanisms, such as snaps (not shown) disposed on the rear panel 14 below the closure mechanism which releasably engage a number of complementary structures (not shown) disposed on the side panel 44 of the storage pouch 38 opposite the secondary pocket 48.

Figure 7:
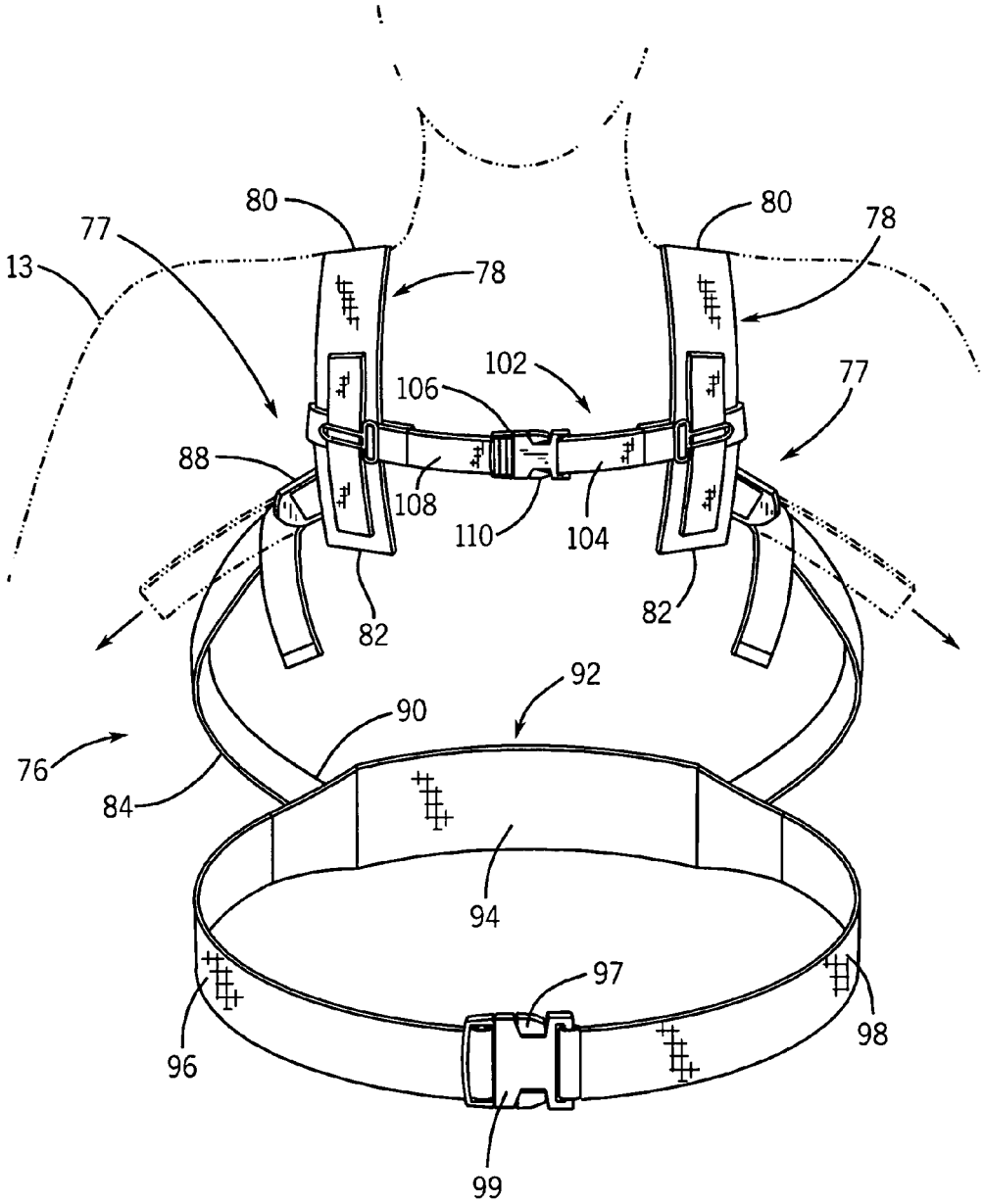
FIG. 7 is an isometric view of the weight support mechanism and a lumbar support strap of FIG. 6 secured to a person.

Looking now at FIGS. 6 and 7, an adjustable weight support mechanism 76 is shown connected to the front panels 12 and rear panel 14 on the interior surface 11*a* of the garment 10. The support mechanism 76 includes a pair of strap assemblies 77 disposed on opposite sides of the garment 10, each assembly 77 having a first strap 78 that is fixedly connected at opposite ends to one of the front panels 12. A first end 80 of each first strap 78 is fixedly connected to the top end 12*a* of the front panel 12, preferably by the stitching used to connect the front panel 12 to the rear panel 14. The second end 82 of each first strap 78 is connected to the front panel 12 at the lower end of the upper portion 23 by the same or a similar means as the first end 80. Further, each of the first straps 78 is oriented to extend downwardly from the top end 12*a* towards the side 12*c* of each front panel 12 from the first end 80 to the second end 82. Each of the first straps 78 is formed of a suitable flexible and optionally elastic material, such as a woven webbing made of fibers of natural or synthetic materials, or rubber. Especially preferred are straps formed of a webbing made of interwoven nylon fibers.

Each of the assemblies 77 also includes a second strap 84 which adjustably connects the first strap 78 to the rear panel 14. Each second strap 84 includes a looped portion 86 secured around and slidable with respect to the first strap 78. The looped portion 86 also includes a buckle 88 that is located opposite the first strap 78. Each second strap 84 also includes an adjustable length portion 90 fixedly secured to the rear panel 14 at one end, and adjustably and slidably engageable with the buckle 88 at the opposite end. The adjustable portion 90 extends at an angle upwardly from the rear panel 14 to the first strap 78 along a line closely similar to the angle of each of the access openings 32. The second straps 84 are formed of materials similar to those used to form the first straps 78.

In addition to the first straps 78 and second straps 84, the assemblies 77 may also include a third strap (not shown) that is connected to the rear panel 14 at a location spaced upwardly from the lower end 14*b* and to the first end 80 of the first strap 78. The third strap functions within the assemblies 77 similar to the rear panel 14.

The mechanism 76 can also optionally include a number of additional support straps used to complement the mechanism 76 and more comfortably position the garment 10 on the wearer 13. The first optional strap is a lumbar support strap 92 fixedly attached to the rear panel 14 over the ends of the adjustable portions 90 of each second strap 84. The lumbar support strap 92 includes a padded central portion 94 which contacts the lower back of wearer when the jacket 10 is worn, and an adjustable length securing strap 96 terminating in a securing member 97 and a retaining strap 98 terminating in a retaining member 99 that extend outwardly from opposite sides of the central portion 94. The securing strap 96 and retaining strap 98 are slidably retained within one of a pair of support loops 100 secured to each front panel 12 on the interior surface 11*a* of the garment 10 opposite the pockets 26. When the garment 10 is properly positioned on the wearer 13 after utilizing the support mechanism 76, the securing member 97 on the adjusted securing strap 96 can be joined to the retaining member 99 on the retaining strap 98 to encircle the waist of the wearer 13 and pull the central portion 94 of the lumbar support 92 into engagement with the lower back of the wearer 13. This allows the lumbar support 92 to provide additional support to the lower back area when the wearer 13 is carrying a number of heavy items within or secured to the storage pocket 38.

The second optional strap is a sternum strap 102 used to releasably connect the first straps 78 to one another when the garment 10 is being worn. The sternum strap 102 enables the first straps 78 to be connected to one another when the front panels 12 are not connected, or only partially connected with one another using the closure 19. The sternum strap 102 includes a first loop 104 slidably attached to one of the first straps 78 and having a receiving portion 106 opposite the first strap 78, and a second loop 108 slidably attached to the other first strap 78 and including a securing portion 110 opposite the other first strap 78. When the garment 10 is worn, the securing portion 108 can be inserted into the receiving portion 104 to engage the sternum strap 102 and secure the first straps 78 to one another over the upper chest area of the wearer 13 to prevent shifting of the first straps 78. Each of the straps 78, 84, 92 and 102 can be made of any suitable material, such as a webbing, formed of a fabric including natural, synthetic, or a combination of natural and synthetic fibers, or any other suitable flexible material.

Figure 8:
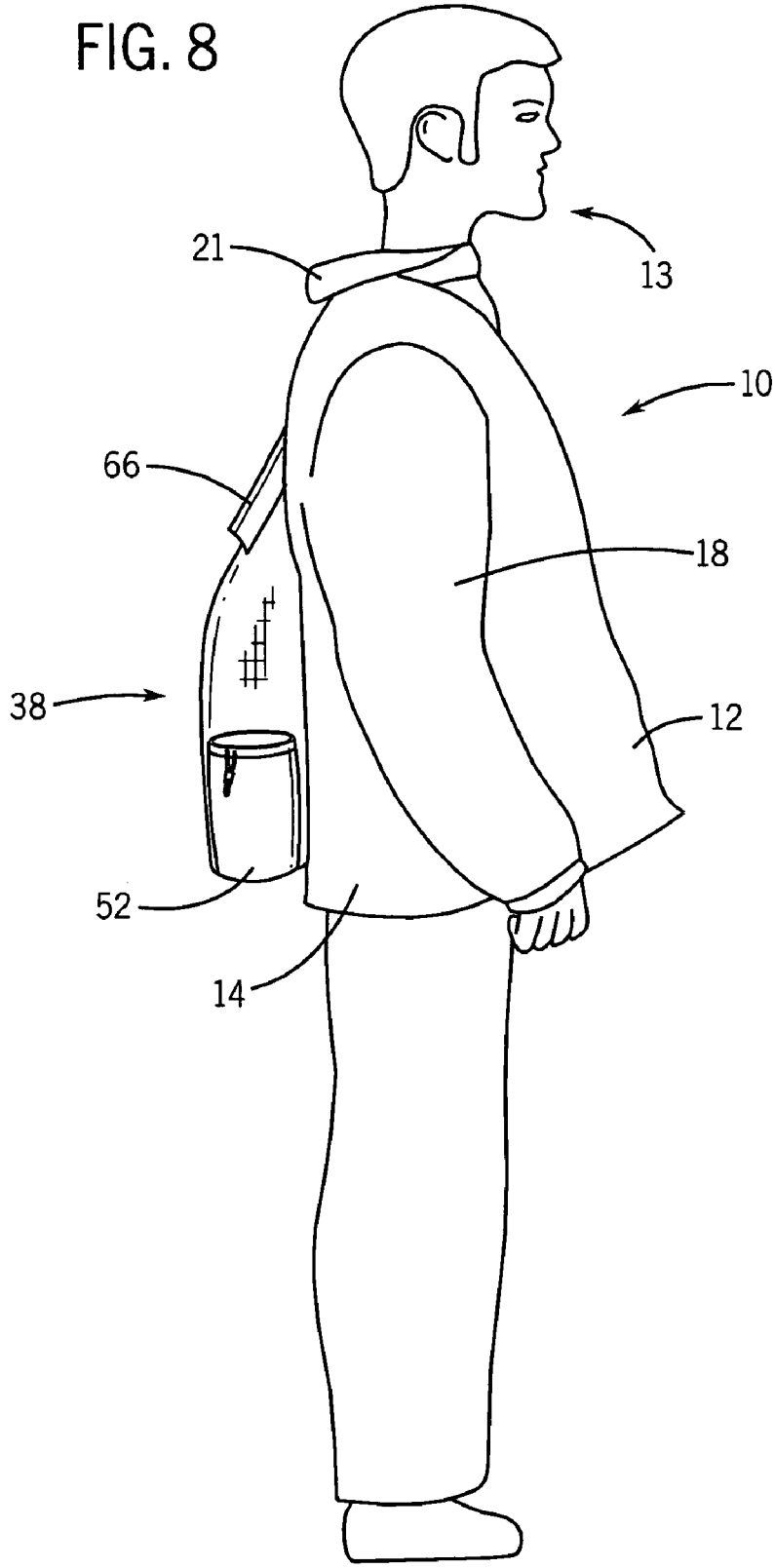
FIG. 8 is a side plan view of the garment of FIG. 1 in an unadjusted position on the person.
Figure 9:
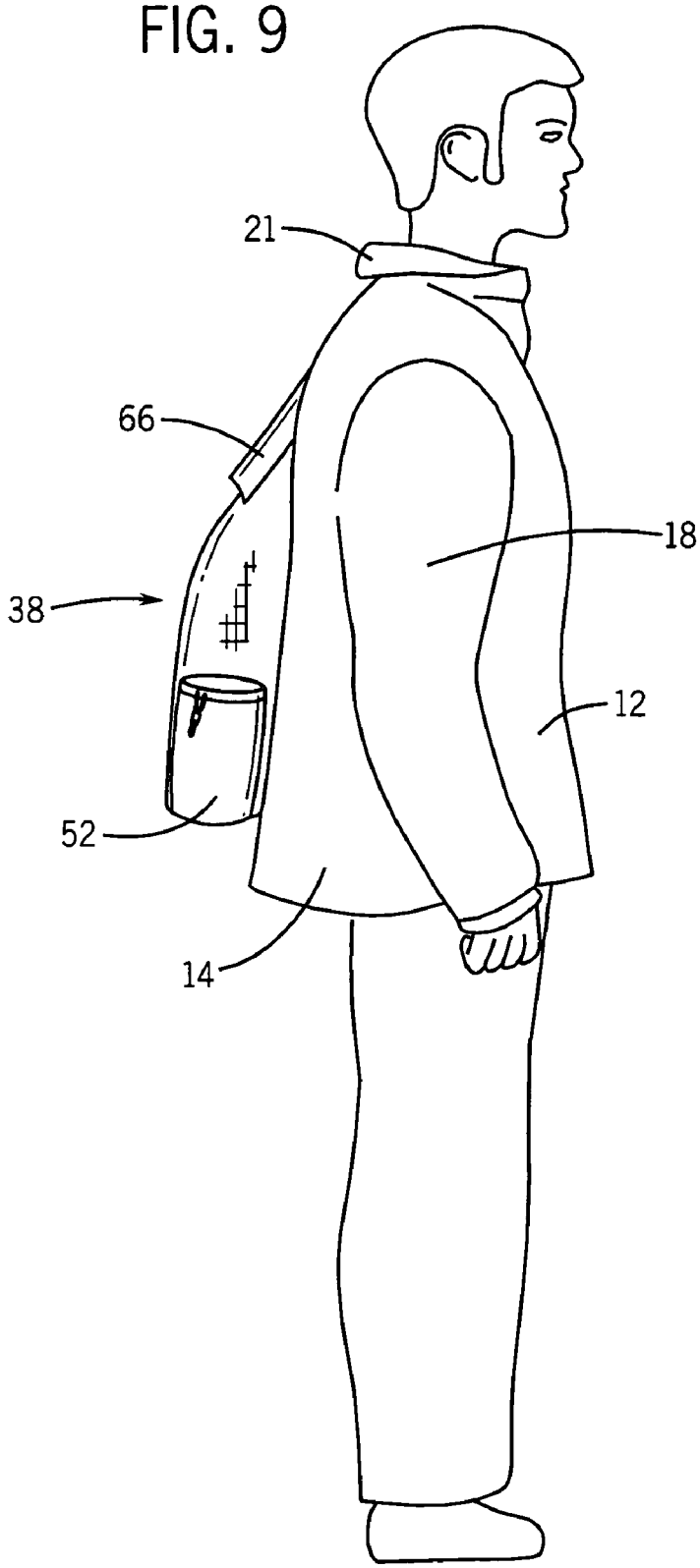
FIG. 9 is a side plan view of the garment of FIG. 1 in an adjusted position on the person.

Referring now to FIGS. 8 and 9, the operation of the support mechanism 76 is shown. Initially, when the wearer 13 puts on the garment 10, the weight of the objects in the pouch 38 pulls the rear panel 14 downwardly, such that the pouch 38 is positioned on the lower back area of the wearer 13 and the collar 21 abuts the neck or chin of the wearer 13 as shown in FIG. 8. Subsequently, in order to use the support mechanism 76 to adjust the positioning of the weight created by a number of items positioned within the storage pouch 38 and secondary pocket 48, after the wearer 13 has put on the garment 10, the wearer 13 opens each of the access openings 32 using the closures 34. The wearer 13 then reaches through the openings 32 and grasps the free end of the adjustable portion 90 of each second strap 84 engaged with the buckle 88 and pulls on the adjustable portion 90 in the directions indicated by the arrows A in FIG. 7 to adjust the length of each second strap 84. By shortening the length of each second strap 84, each second strap 84 pulls the attached first strap 78 downwardly and forwardly to draw the shoulder portions 26 and the upper portion 23 of each front panel 12, to which the first straps 78 are attached, downwardly with respect to the wearer 13. Further, by pulling the shoulder portions 26 and upper portions 23 of the front panels 12 downwardly, the rear panel 14, or third straps, if present, and storage pouch 38 are consequently pulled upwardly, such that the support strap mechanism 76 counteracts the downward force exerted on the rear panel 14 and the wearer 13 by the objects positioned within the storage pouch 38. In this manner, the weight of the objects in the storage pouch 38 is lifted to the position of FIG. 9 and is evenly distributed across the shoulders and upper back of the wearer 13, to avoid causing any undue strain on the lower back of the wearer 13. Further, by adjusting the length of the straps 84, the collar 21 is lowered with respect to the wearer so that the weight of the objects in the pouch 38 does not cause the collar 21 to move upwardly against the neck and chin of the wearer. In essence, the mechanism 76 rotates the garment 10 about the shoulders of the wearer 13 to elevate the pouch 38 and the objects contained therein. The attachment of the second straps 84 to the rear panel 14 and the first straps 76 on the front panels 12 provides the necessary anchor points for the operation of the mechanism 76 without the need for anchoring the mechanism 76 directly to the wearer 13, such as by using a waist belt as shown in the prior art.

After the mechanism 76 has positioned the garment appropriately to distribute the weight of the pouch operably on the wearer 13, the wearer 13 may then secure the garment 10 in this position by engaging the lumbar support strap 92 about the waist of the wearer 13, and engaging the sternum strap 102 across the upper chest of the wearer 13. The lumbar strap 92 and sternum strap 102 function to maintain the garment in the desired position on the wearer 13 such that no shifting of the garment occurs due to the motion of the wearer 13.

While the mechanism 76 is illustrated as being incorporated on the interior surface 11*a* of the garment 10, the mechanism 76 can also have the strap assemblies 77 secured to the exterior surface 11*b* of the garment 10. Further, the mechanism 76 can also be releasably secured to the garment 10 to aid in the cleaning of the garment 10 and to enable the mechanism 76 and pouch 38 to function as a separable carrying item separate from the garment 10. Also, while the garment 10 is disclosed as being a jacket or coat, the mechanism 76 can also be incorporated into other types of garments, such as a vest, a shirt, a pullover, or any other type of garment worn on the torso of one individual.

Various alternatives are contemplated as being within the scope of the following claims particularly point out and distinctly claiming the subject matter regarded as the invention.

I claim:

1. A garment comprising:

a) a front panel having a top end, a bottom end and a pair of opposed sides;

b) a rear panel having an upper end, a lower end and a pair of opposed edges, the rear panel secured to the top end of the front panel at the upper end to form a shoulder portion, and to each opposed side along the opposed edges to form an interior surface and an exterior surface for the garment;

c) at least one article holder secured to the garment; and d) an adjustable weight support mechanism including a pair of first straps secured between the shoulder portion and the front panel, and a pair of second adjustable length straps secured between the first straps and the rear panel, wherein the adjustable weight support mechanism is disposed on the interior surface of the article of clothing.

2. The garment of claim 1 wherein the at least one article holder is a pocket.

3. The garment of claim 2 wherein the at least one article holder is attached to the rear panel.

4. The garment of claim 3 further comprising at least one article holder on the front panel.

5. The garment of claim 1 wherein the pair of first straps are secured to the shoulder portion on opposite sides of a neck opening defined by the top end of the front panel and the upper end of the rear panel.

6. The garment of claim 1 wherein each of the pair of first straps are secured to a seam joining the top end of the front panel to the upper end of the rear panel.

7. A garment of claim 1 comprising:

wherein the pair of first straps extend downwardly at an angle from the shoulder portion to the front panel.

8. The garment of claim 1 further comprising a lumbar support assembly secured to the rear panel.

9. The garment of claim 8 wherein the lumbar support assembly includes a wide center portion secured to the rear panel, a pair of narrow end portions extending from opposite sides of the center portion, a receiver adjustably secured to one end portion, and an engagement member secured to the other end portion and releasably engageable with the receiver.

10. The garment of claim 9 wherein the end portions are slidably attached to the front panel.

11. The garment of claim 10 wherein the lumbar support assembly is disposed on the interior surface.

12. The garment of claim 1 wherein the pair of second straps extend from the pair of first straps to the rear panel beneath a pair of opposed sleeve openings defined between the sides of the front panel and edges of the rear panel beneath the shoulder portion.

13. The garment of claim 1 wherein the support mechanism further includes a sternum strap releasably connected between the first straps.

14. The garment of claim 13 wherein the sternum strap includes a first loop including an engagement member and secured opposite the engagement member to one of the first straps, and a second loop including a receiving member releasably engageable with the engagement member and secured opposite the receiving member to the other first strap.

15. The garment of claim 13 wherein the sternum strap is adjustable in length.

16. The garment of claim 1 wherein the at least one article holder is releasably secured to the rear panel.

17. The garment of claim 16 wherein the at least one article holder is secured to the rear panel by a releasable closure mechanism.

18. The garment of claim 16 wherein the at least one article holder is secured to the rear panel by a number of separate closure mechanisms.

19. The garment of claim 1 wherein the front panel includes a releasable closure mechanism.

20. The garment of claim 19 wherein the releasable closure mechanism is a zipper.

21. The garment of claim 19 wherein the garment is selected from the group consisting of a vest, a jacket, a pullover, and a shirt.

22. A garment comprising:

a) a front panel having a top end, a bottom end and a pair of opposed sides;

b) a rear panel having an upper end, a lower end and a pair of opposed edges, the rear panel secured to the top end of the front panel at the upper end to form a shoulder portion, and to each opposed side along the opposed edges to form an interior surface and an exterior surface for the garment;

c) at least one article holder secured to the garment; and d) an adjustable weight support mechanism including a pair of first straps secured between the shoulder portion and the front panel, and a pair of second adjustable length straps secured between the first straps and the rear panel, wherein each of the pair of second straps are slidably secured to the pair of first straps.

23. The garment of claim 22 wherein each of the pair of second straps includes a buckle, a loop secured to one side of the buckle and slidably positioned around one of the first straps, and an elongate member with one end threaded through the buckle opposite the loop and the other end fixed to the rear panel.

24. The garment of claim 22 wherein the pair of first straps and the pair of second straps are formed of a fabric webbing.

25. A garment comprising:

a) a front panel having a top end, a bottom end and a pair of opposed sides;

b) a rear panel having an upper end, a lower end and a pair of opposed edges, the rear panel secured to the top end of the front panel at the upper end to form a shoulder portion, and to each opposed side along the opposed edges to form an interior surface and an exterior surface for the garment;

c) at least one article holder secured to the garment; and d) an adjustable weight support mechanism including a pair of first straps secured between the shoulder portion and the front panel, and a pair of second adjustable length straps secured between the first straps and the rear panel wherein each of the pair of second straps are slidably secured to the pair of first straps, the adjustable weight support mechanism is disposed on the interior surface of the article of clothing and the front panel includes a pair of openings that extend through the front panel of the article of clothing.

26. The garment of claim 25 wherein the pair of openings include selectively openable closures.

27. A method of adjusting the position of a load supporting garment worn by an individual, the method comprising the steps of:

a) providing a garment including a front panel, a rear panel, at least one article holder attached to the garment, and an adjustable weight support mechanism including a pair of first straps secured at one end to the front panel and to a shoulder portion of the garment at the opposite end, and a pair of adjustable length second straps movably secured at one end to the first straps and secured to the rear panel at the opposite end; and b) pulling on the second straps to adjust the length of the second straps.

28. The method of claim 27 wherein the support mechanism is disposed on an interior surface of the garment and the front panel includes a pair of openings, the method further comprising the step of grasping the second straps through the openings prior to pulling on the second straps.

29. The method of claim 27 wherein the at least one article holder is releasably attached to the rear panel and further comprising the step of attaching the at least one article holder to the rear panel prior to pulling on the second straps.

30. The method of claim 27 wherein the garment includes a sternum straps and further comprising the step of engaging the sternum strap after pulling on the second straps.

31. The method of claim 27 wherein the garment includes a lumbar strap and further comprising the step of engaging the lumbar strap after pulling on the second straps.

32. A garment comprising:

a) a front panel;

b) a rear panel secured to the front panel;

c) at least one article holder attached to the rear panel; and d) an adjustable weight support mechanism including a pair of first straps secured to the front panel and a pair of adjustable length second straps slidably secured at one end to the first straps and secured to the rear panel at the other end.

33. The garment of claim 32 wherein the support mechanism is disposed on an interior surface of the garment.

* * * * *